US007521876B2

(12) United States Patent
Keith et al.

(10) Patent No.: US 7,521,876 B2
(45) Date of Patent: Apr. 21, 2009

(54) ELECTRONIC BALLAST WITH LAMP TYPE DETERMINATION

(75) Inventors: William L. Keith, Lake in the Hills, IL (US); George L. Grouev, Arlington Heights, IL (US); Kent E. Crouse, Carpentersville, IL (US)

(73) Assignee: Koninlijke Philips Electronics, N.V., Eindhoven (NL)

( * ) Notice: Subject to any disclaimer, the term of this patent is extended or adjusted under 35 U.S.C. 154(b) by 169 days.

(21) Appl. No.: 10/596,330

(22) PCT Filed: Dec. 9, 2004

(86) PCT No.: PCT/IB2004/052736

§ 371 (c)(1),
(2), (4) Date: Jun. 9, 2006

(87) PCT Pub. No.: WO2005/060319

PCT Pub. Date: Jun. 30, 2005

(65) Prior Publication Data

US 2007/0090822 A1 Apr. 26, 2007

Related U.S. Application Data

(60) Provisional application No. 60/528,637, filed on Dec. 11, 2003.

(51) Int. Cl.
*H05B 37/02* (2006.01)

(52) U.S. Cl. ..... 315/291; 315/224; 315/247

(58) Field of Classification Search ..... 315/224–225, 315/246–247, 291, 307–308
See application file for complete search history.

(56) References Cited

U.S. PATENT DOCUMENTS

| | | | | |
|---|---|---|---|---|
| 4,638,395 | A | 1/1987 | Nilssen | |
| 4,933,605 | A | 6/1990 | Quazi et al. | |
| 5,039,921 | A | 8/1991 | Kakitani | |
| 5,055,747 | A | 10/1991 | Johns | |
| 5,317,237 | A | 5/1994 | Allision et al. | |
| 5,751,115 | A * | 5/1998 | Jayaraman et al. | 315/225 |
| 5,910,709 | A * | 6/1999 | Stevanovic et al. | 315/225 |
| 5,925,990 | A | 7/1999 | Crouse et al. | |
| 6,051,940 | A | 4/2000 | Arun | |
| 6,239,558 | B1 * | 5/2001 | Fujimura et al. | 315/307 |

(Continued)

FOREIGN PATENT DOCUMENTS

EP 0681414 A2 11/1995

*Primary Examiner*—Douglas W Owens
*Assistant Examiner*—Tung X Le

(57) ABSTRACT

An electronic ballast includes open circuit voltage regulation comprises an filament current sensing circuit 224 operably connected to an output of the electronic ballast and generating a sensed output voltage signal, and a regulating pulse width modulator U3 receiving the sensed output voltage signal and operably connected to control voltage at the output of the electronic ballast, the regulating pulse width modulator U3 having an output voltage threshold limit. The regulating pulse width modulator U3 limits the voltage at the output of the electronic ballast when the sensed output voltage signal exceeds the output voltage threshold limit. The regulating pulse width modulator U3 can limit the output voltage by limiting the pulse width to the high voltage driver and the resonant half bridge. The filament current sensing circuit 224 can sense the output voltage indirectly, such as by sensing tank current, or can sense the output voltage directly.

8 Claims, 4 Drawing Sheets

U.S. PATENT DOCUMENTS

| | | | | |
|---|---|---|---|---|
| 6,531,831 | B2 * | 3/2003 | Chou et al. | 315/225 |
| 7,098,606 | B2 * | 8/2006 | Yu et al. | 315/291 |
| 2002/0180380 | A1 * | 12/2002 | Lin | 315/224 |
| 2003/0132739 | A1 * | 7/2003 | Telefus et al. | 323/284 |
| 2004/0037094 | A1 * | 2/2004 | Muegge et al. | 363/21.16 |
| 2006/0175983 | A1 * | 8/2006 | Crouse et al. | 315/291 |

* cited by examiner

ELECTRONIC BALLAST WITH LAMP TYPE DETERMINATION

CROSS REFERENCE TO RELATED APPLTCATION

This application claims the benefit of U.S. provisional application Ser. No. 60/528,G37, filed Dec. 12, 2003, which the entire subject matter is incorporated herein by reference.

This invention relates to electronic ballasts for gas discharge lamps, and more particularly, to an electronic ballast able to regulate open circuit voltage.

Gas discharge lamps, such as fluorescent lamps, require a ballast to limit the current to the lamp. Electronic ballasts have become increasingly popular due to their many advantages. Electronic ballasts provide greater efficiency—as much as 15% to 20% over magnetic ballast systems. Electronic ballasts produce less heat, reducing building cooling loads, and operate more quietly, without "hum." In addition, electronic ballasts offer more design and control flexibility.

Electronic ballasts must operate with different supply voltages, different types of lamps, and different numbers of lamps. Supply voltages vary around the world and may vary in a single location depending on the power grid. Different types of lamps may have the same physical dimensions, so that different types of lamps can be used in a single fixture, yet be. different electrically. An electronic ballast may operate with a single lamp, or two or more lamps. The electronic ballast must operate reliably and efficiently under the various conditions.

One particular challenge is to regulate ballast output voltage when the electronic ballast is unloaded, i.e., when there is an open circuit at the ballast output. Operating at the electronic ballast's self resonant frequency, the output voltage is extremely high. The high output voltage results in severe operating conditions for certain electronic ballast components. The current in the half bridge transistors of the resonant half bridge circuit, which drive the tank circuit on the electronic ballast output, are subject to large currents that cause the half bridge transistors to fail. Electronic ballasts presently regulate ballast output voltage using complex, expensive circuits to measure output voltage and process the measured output voltage in a microprocessor. The output voltage measurement circuits typically require extra components, such as filters, rectifiers, or voltage detection coils, which increase the electronic ballast expense. The microprocessor typically requires a number of time consuming steps and subroutines to decide if there is an open circuit at the ballast output, which increases the likelihood of component damage while the microprocessor decides if there is a problem. U.S. Pat. No. 5,039,921 to Kakitani discloses a discharge lamp lighting apparatus which includes a voltage detection coil that monitors voltage applied to a discharge lamp and provides input to a central processing unit. U.S. Pat. No. 5,925,990 to Crouse et al. discloses an electronic ballast with a microprocessor containing a stored program for reducing output voltage when a fault is detected.

It would be desirable to have an electronic ballast with open circuit voltage regulation that would overcome the above disadvantages.

One aspect of the present invention provides an electronic ballast affording open circuit voltage regulation using components available in the electronic ballast.

Another aspect of the present invention provides an electronic ballast affording open circuit voltage regulation with quick response.

Another aspect of the present invention provides an electronic ballast affording open circuit voltage regulation using a simple, inexpensive circuit.

The foregoing and other features and advantages of the invention will become further apparent from the following detailed description of the presently preferred embodiments, read in conjunction with the accompanying drawings. The detailed description and drawings are merely illustrative of the invention, rather than limiting the scope of the invention being defined by the appended claims and equivalents thereof.

Various embodiment of the present invention are illustrated by the accompanying figures, wherein.

Figure 1:
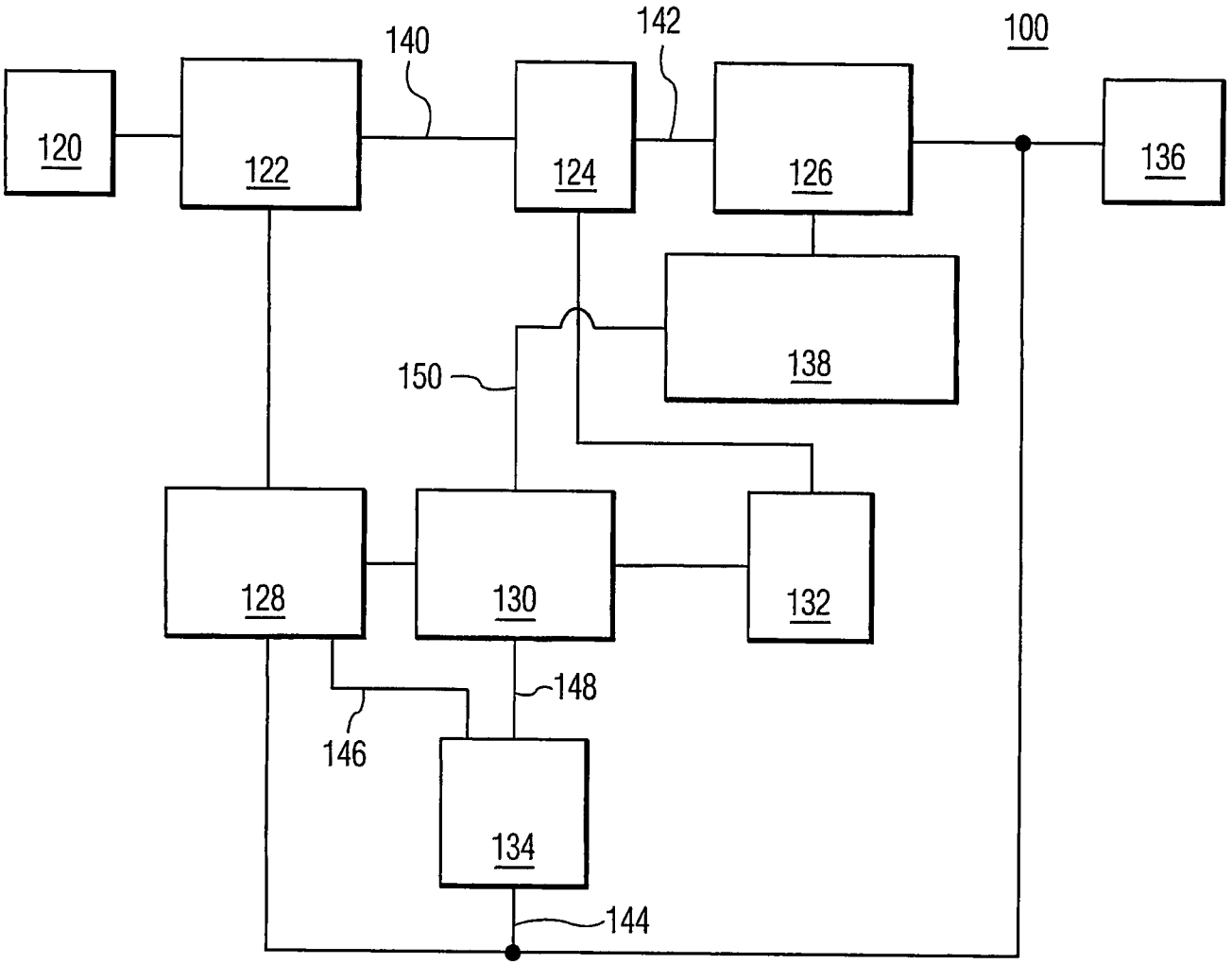
FIG. 1 is a block diagram of an electronic ballast with open circuit voltage regulation made in accordance with the present invention.

FIG. 1 is a block diagram of an electronic ballast with lamp type determination made in accordance with the present invention. The electronic ballast 100 consists of AC/DC converter 122, half bridge 124, resonant tank circuit 126, microprocessor 128, regulating pulse width modulator (PWM) 130, high voltage (HV) driver 132, error circuit 134, and a filament current sensing circuit 138. The AC/DC converter 122 receives the mains voltage 120 and the tank circuit 126 provides power to the lamp 136.

The mains voltage 120 is the AC line voltage supplied to the electronic ballast 100, such as 120V, 127V, 220V, 230V, or 277V. The mains voltage 120 is received at the AC/DC converter 122. The AC/DC converter 122 converts the AC mains voltage 120 to DC voltage 140, which is supplied to the half bridge 124. The AC/DC converter 122 typically includes an EMI filter and a rectifier (not shown). The AC/DC converter 122 can also include a boost circuit to increase the voltage of the DC voltage, such as from 180V to 470V. The half bridge 124 converts the DC voltage 140 to a high frequency AC voltage 142. The resonant tank circuit 126 supplies the AC voltage to the lamp 136. The high frequency AC voltage typically has a frequency in the range of 25 to 60 kHz The microprocessor 128 controls the operation of the electronic ballast 100. The microprocessor 128 stores and operates on programmed instructions, and senses parameters from throughout the electronic ballast 100 to determine the desired operating points. For example, the microprocessor 128 sets the AC voltage to different frequencies, depending on whether the lamp is in the preheat, strike, or run mode, or if no lamp is present. The microprocessor 128 can control the power conversion and voltage output from the AC/DC converter 122. The microprocessor 128 can also control the voltage and frequency of the AC voltage from the resonant tank circuit 126, by controlling the frequency and duty cycle of the half bridge 124 through the regulating PWM 130 and the HV driver 132. The error circuit 134 compares sensed lamp current 144 and desired lamp current 146 and provides a lamp current error signal 148 to the regulating PWM 130 for adjustment of lamp current through the regulating PWM 130 and the HV driver 132.

The filament current sensing circuit 138 detects ballast output voltage at the tank circuit 126 and provides a sensed output voltage signal 150 to the regulating PWM 130. The regulating PWM 130 uses the output voltage signal 150 to determine if an open circuit exists. Should an open circuit exist, the output voltage is controlled by limiting the duty cycle of the resonant half bridge 124 through the regulating PWM 130 and the HV driver 132.

Figure 2:
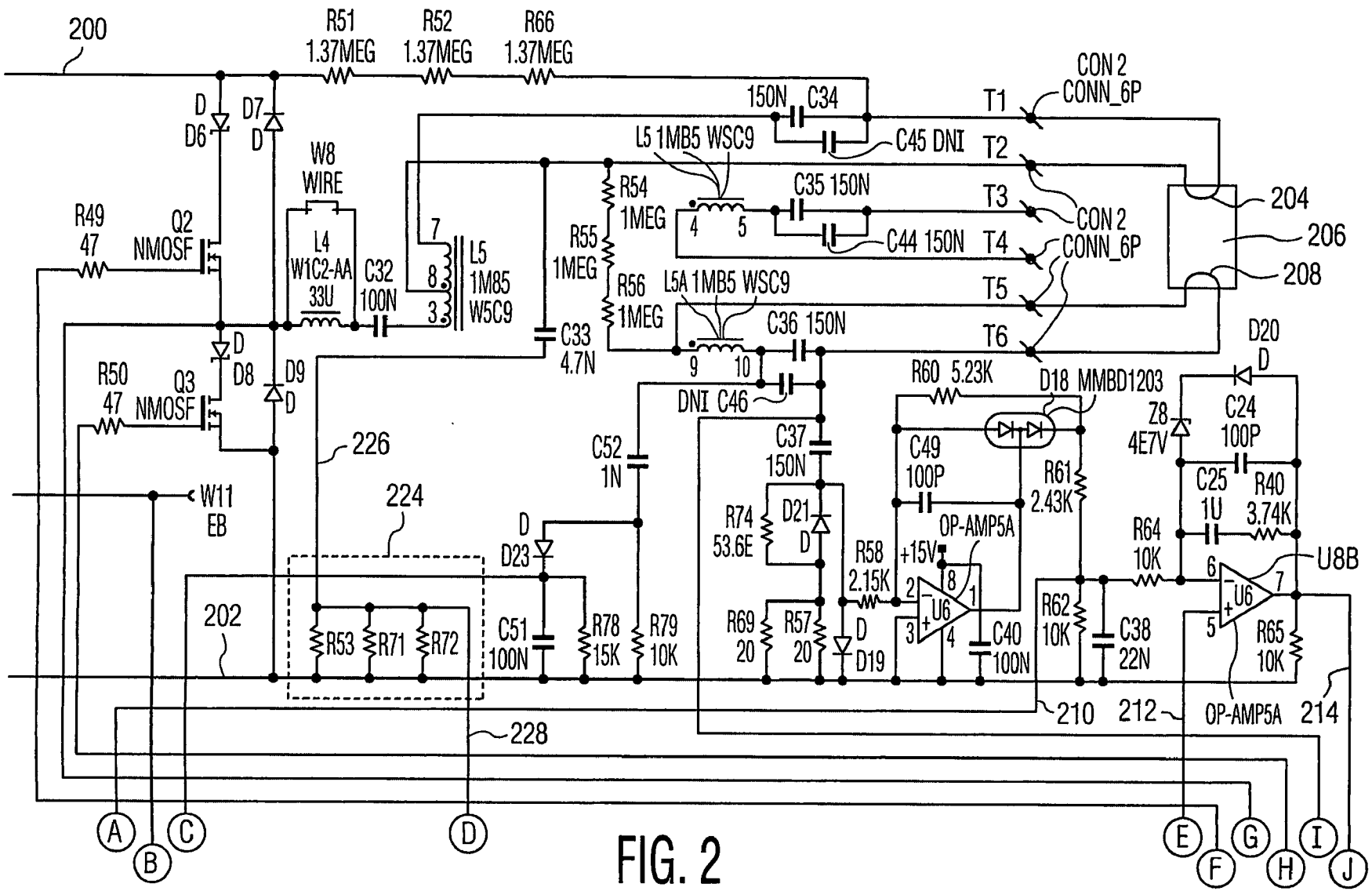
FIGS. 2 & 3 are schematic diagrams of an electronic ballast with open circuit voltage regulation made in accordance with the present invention.
Figure 3:
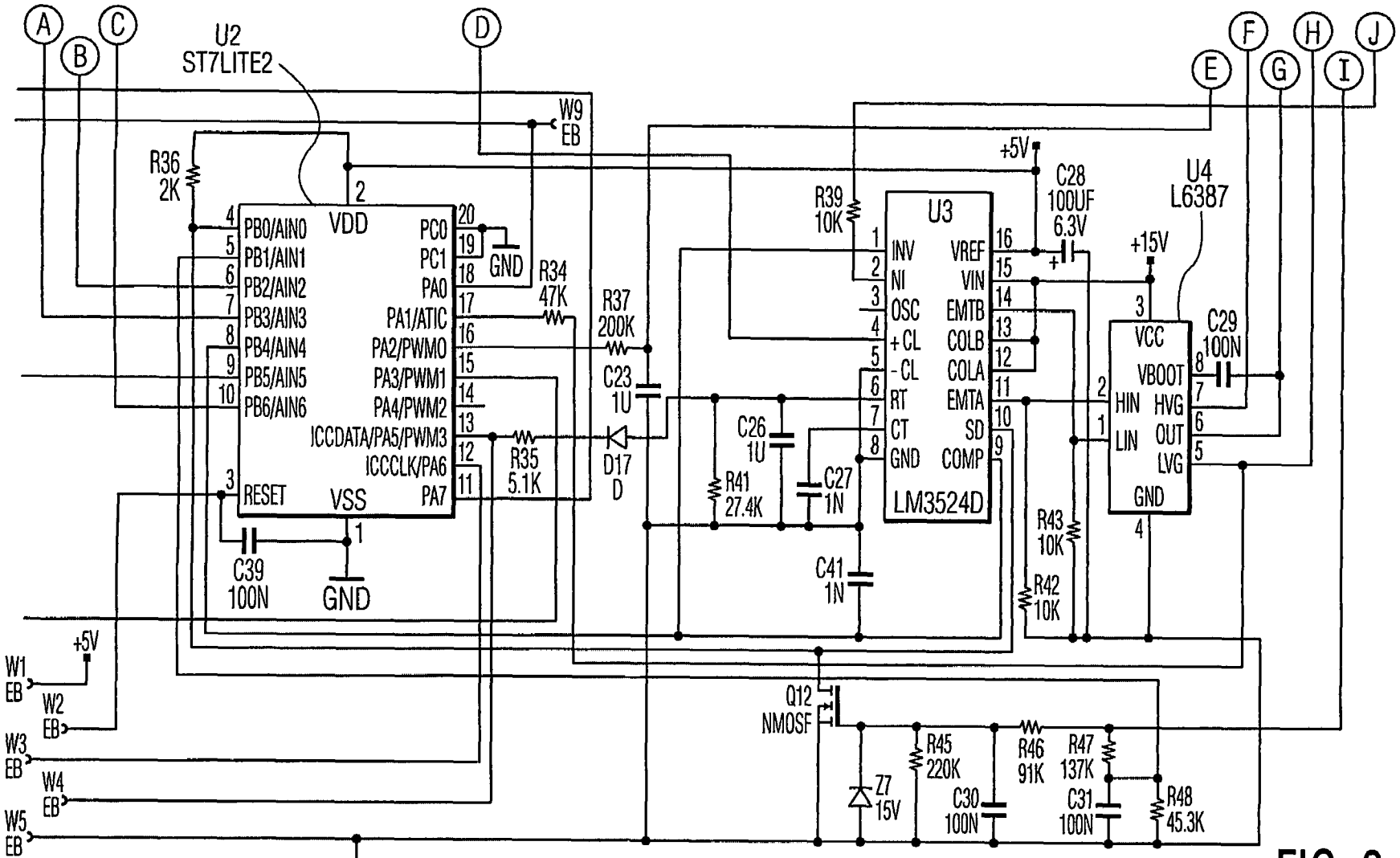

FIGS. 2 & 3 are schematic diagrams of an electronic ballast with open circuit voltage regulation made in accordance with the present invention.

Referring to FIG. 2, DC power is supplied to the resonant half bridge across high voltage rail 200 and common rail 202 by the AC/DC converter (not shown). Transistors Q2 and Q3 are connected in series between high voltage rail 200 and common rail 202 to form a half bridge circuit. The HV driver U4 of FIG. 3 drives the transistors Q2 and Q3 so that they conduct alternately. Inductor L5 and capacitor C33 form the resonant tank circuit and smooth the output at the junction between transistors Q2 and Q3 into a sinusoidal waveform. For use with a single lamp, the first filament 204 of the lamp 206 is connected across terminals T1 and. T2 and the second filament 208 is connected across terminals T5 and T6. When two lamps are used with the electronic ballast, one filament from the first lamp is connected across terminals T1 and T2 and the one filament from the second lamp is connected across terminals T5 and T6. The other filaments, one from each lamp, are connected in series or parallel across terminals T3 and T4.

Referring to FIG. 3, the microprocessor U2 is operable to receive inputs from inside and outside the electronic ballast, and to control ballast operation. The microprocessor U2 determines the desired lamp operating frequency and sets the oscillator frequency of the regulating PWM U3, which drives the HV driver U4. The HV driver U4 drives the transistors Q2 and Q3. In one embodiment, the microprocessor U2 can be an ST7LITE2 available from STMicroelectronics, the regulating PWM U3 can be an LM3524D available from National Semiconductor, and the HV driver U4 can be an L6387 available from STMicroelectronics. Those skilled in the art will appreciate that the particular components other than the exemplary components described can be selected to achieve the desired result.

The error circuit senses lamp current at resistor R58 through capacitor C37. Current op amp U8A and high conductance ultra fast diode DI 8 compose a half wave rectifier with resistors R60 and R58 controlling gain. The sensed lamp current signal is provided to the microprocessor U2 on line 210 and to the error op amp U8B. The microprocessor U2 generates a desired lamp current signal based on inputs and the desired operating condition and returns the desired lamp current signal to the error op amp U8B along line 212. The error op amp U8B compares the sensed lamp current signal and the desired lamp current signal to generate a lamp current error signal on line 214, which provides the lamp current error signal to the regulating PWM U3. In response to the lamp current error signal, the regulating PWM U3 adjusts output pulse width, which adjusts the lamp current by the cycling of the transistors Q2 and Q3 with the HV driver U4. When the sensed lamp current signal equals the desired lamp current signal at the error op amp U8B, the lamp current error signal will zero out and the electronic ballast will be in a steady state mode.

The electronic ballast operates in preheat, strike, and run modes. The preheat mode provides a preheat sequence to the lamp filaments to induce thermionic emission and provide an electrical path through the lamp. The strike mode applies a high voltage to ignite the lamp. The run mode controls the current through the lamp after ignition.

Referring to FIG. 2, the filament current sensing circuit 224 consists of resistors R53, R71, and R72. The filament current sensing circuit 224 is connected in series with the resonant capacitor C33 in the tank circuit to the common rail 202. The filament current sensing circuit 224 receives the tank current on line 226 and provides a sensed output voltage signal on line 228 to the positive current limiting sense input of the regulating PWM U3. The negative current limiting sense input of the regulating PWM U3 is connected to ground. The tank current on line 226 is proportional to the output voltage across the lamp 206.

The positive current limiting sense input of the regulating PWM U3 provides a output voltage threshold limit for the sensed output voltage signal. When the sensed output voltage signal exceeds the output voltage threshold limit, such as when there is an open circuit at the ballast output, the regulating PWM U3 limits the pulse width to a maximum pulse width. This limits the output voltage from the electronic ballast and protects the half bridge transistors. For an embodiment using an LM3524D regulating PWM available from National Semiconductor as the regulating PWM U3, the positive current limiting sense input has a set trip level of 200 mV. The individual resistors in the filament current sensing circuit 224 (R53, R7 1, and R72) are sized so that the sensed output voltage signal is below the trip level during normal operation and exceeds the trip level if there is an open circuit at the ballast output.

In operation, the filament current sensing circuit 224 monitors the tank current, which indicates the output voltage across the lamp 206. The filament current sensing circuit 224 is responsive to the tank current and generates the sensed output voltage signal. The sensed output voltage signal is monitored by the regulating PWM U3. When the sensed output voltage signal exceeds the output voltage threshold limit, the regulating PWM U3 reduces the output pulse width. This limits the PWM drive signal to the HV driver U4, which limits the HV drive signal to the half bridge transistors Q2 and Q3 in the resonant half bridge to limit and regulate the ballast output voltage.

Those skilled in the art will appreciate that a number of different circuits and components can be used to obtain the sensed output voltage signal representing the ballast output voltage and that the circuit is not limited to the example presented above in which the sensed output voltage signal is obtained from the tank current. In another embodiment, the ballast output voltage can be monitored directly to provide the sensed output voltage signal. Direct voltage measurement can be performed with a resistive voltage divider or voltage step-down transformer connected to the resonant tank output. In another embodiment, a current transformer is used in place of the sense resistors in the filament current sensing circuit 224 to measure resonant capacitor current.

Figure 4:
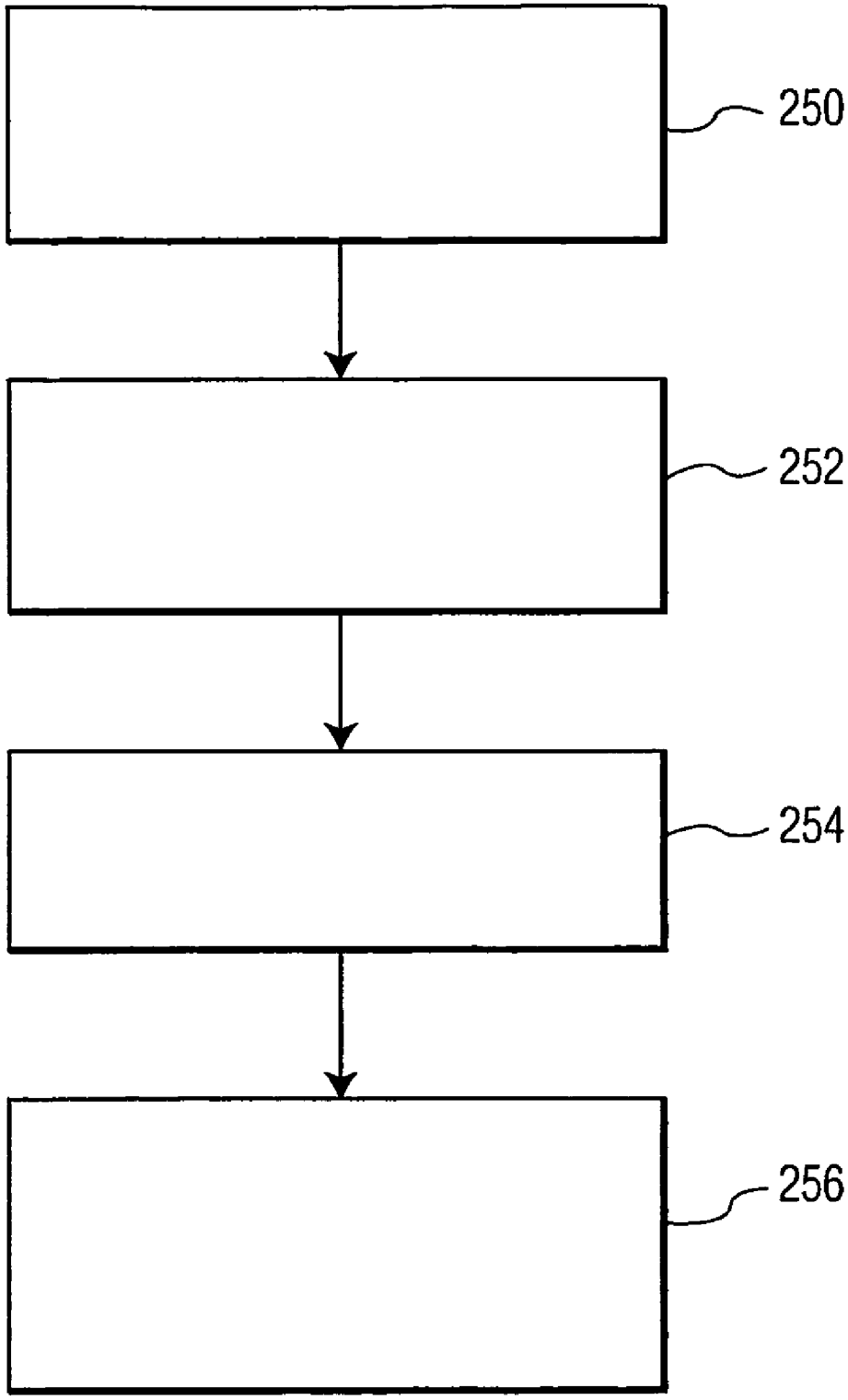
FIG. 4 is a flow chart of a method of open circuit voltage regulation for an electronic ballast made in accordance with the present invention.

FIG. 4 is a flow chart of a method of open circuit voltage regulation for an electronic ballast made in accordance with the present invention. A regulating pulse width modulator having an output voltage threshold limit is provided at 250. The output voltage from the electronic ballast is sensed to generate a sensed output voltage signal at 252 and the sensed output voltage signal is compared to the output voltage threshold limit at 254. At 256, the output voltage is limited when the sensed output voltage signal exceeds the output voltage threshold limit. The output voltage from the electronic ballast can be limited by the regulating pulse width modulator U3 limiting the pulse width driving the high voltage driver U4, which drives the resonant half bridge. In one embodiment, sensing output voltage from the electronic ballast comprises sensing tank current. In another embodiment, sensing output voltage from the electronic ballast comprises sensing output voltage directly.

While the embodiments of the invention disclosed herein are presently considered to be preferred, various changes and modifications can be made without departing from the spirit and scope of the invention. The scope of the invention is indicated in the appended claims, and all changes that come within the meaning and range of equivalents are intended to be embraced therein.

The invention claimed is:

1. A method for open circuit voltage regulation for an electronic ballast, the method comprising:

providing a resonant tank circuit connected to an output of the electronic ballast;

providing a regulating pulse width modulator having an output voltage threshold limit;

sensing a tank current in the resonant tank circuit to produce a sensed output voltage signal;

comparing the sensed output voltage signal to the output voltage threshold limit; and limiting the output voltage when the sensed output voltage signal exceeds the output voltage threshold limit by limiting a pulse width of pulses output from the regulating pulse width modulator.

2. The method of claim 1 wherein sensing the tank current comprises sensing a voltage across a resistance between a resonant capacitor and a common rail.

3. A system for open circuit voltage regulation for an electronic ballast, the system comprising:

pulse width modulating means for modulating a pulse width of pulses, said pulse width modulation means having an output voltage threshold limit;

a resonant tank circuit connected to an output of the electronic ballast;

means for sensing a tank current in the resonant tank circuit to generate a sensed output voltage signal;

means for comparing the sensed output voltage signal to the output voltage threshold limit; and means for limiting the output voltage when the sensed output voltage signal exceeds the output voltage threshold limit by limiting the pulse width of the pulses.

4. The system of claim 3 wherein the means for sensing tank current comprises means for sensing voltage across a resistance between a resonant capacitor and a common rail.

5. An open circuit voltage regulation circuit for an electronic ballast, the regulation circuit comprising:

a resonant tank circuit operably connected to an output of the electronic ballast and generating a sensed output voltage signal; and a regulating pulse width modulator receiving the sensed output voltage signal and operably connected to control a voltage at the output of the electronic ballast, the regulating pulse width modulator having an output voltage threshold limit;

wherein the regulating pulse width modulator limits the voltage at the output of the electronic ballast when the sensed output voltage signal exceeds the output voltage threshold limit by limiting a pulse width of pulses output from the regulating pulse width modulator.

6. The circuit of claim 5 further comprising a tank circuit sensing circuit comprising a resistance between a resonant capacitor of the resonant tank circuit and a common rail.

7. The circuit of claim 6 wherein the regulating pulse width modulator has a set trip level for the output voltage threshold limit and the resistance is sized so that the sensed output voltage signal exceeds the set trip level when the electronic ballast has an open circuit.

8. The circuit of claim 5 further comprising a high voltage driver operably connected to be driven by the regulating pulse width modulator, and the regulating pulse width modulator limits the voltage at the output of the electronic ballast by driving the high voltage driver at a limited pulse width.

* * * * *